United States Patent [19]

Eckert

[11] 4,364,361

[45] Dec. 21, 1982

[54] FUEL INJECTION SYSTEM

[75] Inventor: Konrad Eckert, Stuttgart, Fed. Rep. of Germany

[73] Assignee: Robert Bosch GmbH, Stuttgart, Fed. Rep. of Germany

[21] Appl. No.: 118,016

[22] Filed: Feb. 4, 1980

[30] Foreign Application Priority Data

Feb. 21, 1979 [DE] Fed. Rep. of Germany ..... 2906597

[51] Int. Cl.[3] ..... F02M 69/00

[52] U.S. Cl. ..... 123/453; 123/454

[58] Field of Search ..... 123/452, 453, 454, 455, 123/179 L

[56] References Cited

U.S. PATENT DOCUMENTS

| | | | |
|---|---|---|---|
| 3,809,036 | 5/1974 | Knapp | 123/452 |
| 3,930,481 | 1/1976 | Eckert | 123/453 |
| 3,967,607 | 7/1976 | Eckert | 123/452 |
| 3,981,288 | 9/1976 | Wessel | 123/455 |
| 3,993,032 | 11/1976 | Passera | 123/453 |
| 3,993,034 | 11/1976 | Passera et al. | 123/453 |
| 4,075,995 | 2/1978 | Kramer | 123/454 |

*Primary Examiner*—Charles J. Myhre
*Assistant Examiner*—Carl Stuart Miller
*Attorney, Agent, or Firm*—Edwin E. Greigg

[57] ABSTRACT

The present invention relates to a fuel injection system designed to supply fuel to a mixture compressing externally ignited internal combustion engine. The fuel injection system comprises an air metering member which is displaceable in a suction tube in accordance with the air flow rate and which displaces the movable part of a fuel metering valve in opposition to a resetting force which is produced by fuel operative in a pressure chamber into which projects an effective face of the movable part of the metering valve. The fuel is metered at the fuel metering valve under a specific pressure difference determined by the regulating valve means, the regulating valve means being influenced by the pressure in a control pressure line in which the pressure chamber is also disposed. Enrichment of the fuel-air mixture is obtained by varying the pressure difference of at least a first throttle by means of an electromagnetic valve disposed in the control pressure line and controllable of a function of the operating parameters of the internal combustion engine.

8 Claims, 2 Drawing Figures

FUEL INJECTION SYSTEM

BACKGROUND OF THE INVENTION

The present invention is a development of a fuel injection system of the type generally revealed in the Stumpp et al. U.S. Pat. No. 4,018,200, which is assigned to the same assignee. A fuel injection system which only permits limited enrichment rates already exists.

The advantage of the fuel injection system according to the invention which comprises the characterizing features that very high enrichment rates for influencing the fuel-air mixture as a function of the operating parameters of the internal combustion engine can be produced in the control pressure line by simultaneously reducing the differential pressure at the fuel metering valve and the pressure produced by the resetting force on the air metering member.

Advantageous developments and improvements can be made to the fuel injection system defined by the measures described herein.

A particularly advantageous measure consists in arranging the first throttle in the region of the connection point between the control pressure line and the fuel supply line and in arranging the regulating valves, the second throttle, the pressure chamber and the sequentially controllable electromagnetic valve downstream of the first throttle. As a result of this measure, it is possible to obtain higher enrichment rates in the fuel injection system without increasing the pressure.

The invention will be better understood and further objects and advantages thereof will become more apparent from the ensuing detailed description of preferred embodiments taken in conjunction with the drawings.

DRAWINGS

Two embodiments of the invention are shown in simplified form in the drawing and are described in further detail in the following description.

FIG. 1 is a diagrammatic representation of a first embodiment of a fuel injection system; and FIG. 2 is a diagrammatic representation of a second embodiment of a fuel injection system.

DESCRIPTION OF THE EMBODIMENTS

Figure 1:
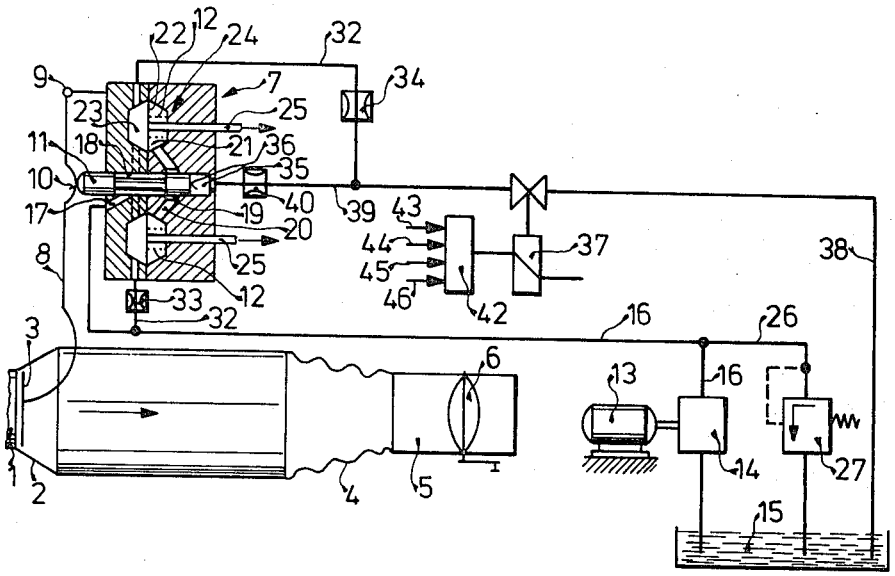

In the fuel injection system represented in FIG. 1, the combustion air flows in the direction of the arrow into a suction tube sector 1, a conical sector 2 comprising a metering member 3 and further through a connecting hose 4 and a suction tube sector 5 containing an arbitrarily actuable butterfly valve 6 to one or several cylinders (not shown) of a mixture compressing, externally ignited internal combustion engine. The metering member 3 is a plate disposed transverse to the stream direction which moves within the conical sector 2 of the suction tube according to an approximately linear function of the air quantity flowing through the suction tube, whereby the pressure prevailing between the metering member 3 and the butterfly 6 remains constant so long as both the resetting force acting upon metering member 3 as well as the air pressure prevailing upstream of metering member 3 remain constant.

The metering member 3 controls directly a metering and quantity divider valve 7. A lever 8 pivotally freely about a pivoting point 9 serves to transmit the setting motions of metering member 3 and is provided with an extension 10 which actuates the movable valve member of the metering and quantity divider valve 7 embodied as a control slide 11.

An electric motor 13 drives a fuel pump 14 which delivers fuel from a fuel container 15, via a line 16 and a channel 17, into an annular groove 18 of the control slide 11. Depending on the position of the control slide 11, the annular groove 18 more or less overlaps control slits 19, each of which communicates via channels 20 with a respective chamber 21 separated by a respective diaphragm 22 from a respective chamber 23. Each diaphragm 22 serves as a movable member of a flat seat valve embodied as an equal pressure valve 24. The fuel flows from the chambers 21 via injection channels 25 to the individual injection valves (not shown) which discharge into the suction tube in the vicinity of the engine cylinders. The regulating valves 24 may be in the form of differential pressure valves comprising pressure springs 12 in the chambers 21, as shown, or in the form of equal pressure valves without pressure springs.

A line 26 branching off from the line 16 contains a pressure limiting valve 27 which permits the return flow of fuel into the fuel container 15.

Also branching off from the line 16 is a line 32 which contains in series, a first throttle 33, the control chambers 23 of the regulating valves 24, a second throttle 34, a pressure chamber 35, into which the face of the control slide 11 remote from the lever 8 projects, and an electromagnetic valve 37. Unpressurized fuel from the control pressure circuit 32 may return to the fuel container 15 via the electromagnetic valve 37 through a return line 38.

The pressure of the fuel in the pressure chamber 35 on the leading face 36 of the control slide 11 produces the resetting force on the metering member 3. A pressure regulating throttle 40 is advantageously disposed in a connecting line 39 from the section of the control pressure line 32 between the second throttle 34 and the electromagnetic valve 37 to the pressure chamber 35. The regulating throttle 40 serves to control pulses in the pressure chamber caused by air pulses which act on the metering member 3. The electromagnetic valve 37 is controlled by an electrical control device 42 which may be supplied with the following: the operating parameters of the internal combustion engine converted into electrical quantities and represented for example by arrows, the exhaust gas composition 43 determined by means of an oxygen probe, the air temperature 44, the geodedic level 45, or the throttle valve setting 46.

The fuel injection system shown in FIG. 1 operates in the following manner:

When the internal combustion engine is running, air is aspirated through the suction tube 1, 4 and 5, and causes a certain displacement of the metering member 3 from its rest position. The excursion of the metering member 3 is transmitted via the lever 8 to cause a displacement of the control slide 11 in the metering and quantity divider valve 7 which meters out the fuel quantity flowing through the fuel injection valves.

In order to maintain the fuel-air mixture in a relatively richer or leaner condition, depending on the portion of the operational domain of the internal combustion engine, a change of the proportionality between the aspirated air quantity and metered out fuel quantity is necessary in dependence on the motor parameters. The change in the fuel-air mixture can be produced by varying the differential pressure at the metering and quantity divider valve 7 and by simultaneously varying the fuel which is in the control pressure line 32 and which produces the resetting force on the air metering member 3.

In the present embodiment, the combined variation of the differential pressure at the control slits 19 of the metering valves 18, 19 and of the fuel pressure in the pressure chamber 35 is produced by dividing the pressure at the first throttle 33 and the second throttle 34 by means of the influencible fuel quantity flowing through the electromagnetic valve 37. When the electromagnetic valve 37 is open, the quantity of fuel flowing in the control pressure line 32 is determined solely by the throttles 33 and 34 and by the throttling of the electromagnetic valve 37, thereby insuring that the pressure difference at the first throttle 33 and accordingly also the pressure difference of the control slits 19 of the metering valves 18, 19 is at maximum and the pressure in the pressure chamber 35 and thus the resetting force of the metering element 3 is at a minimum.

Accordingly, the maximum enrichment rates, i.e., the richest fuel-air mixture is obtained when the electromagnetic valve 37 is open as when a constant air quantity is drawn in the maximum pressure difference at the control slits 19 of the metering valves 18, 19 produces the maximum quantity of fuel metered and the minimum resetting force on the metering member 3 results in an additional displacement of the control slide 11 in the opening direction of the control slits 19 of the metering valves 18, 19. The combined enrichment of the fuel-air mixture results both from the enrichment produced by the pressure difference at the control slits 19 of the metering valves 18, 19 and from the enrichment produced by reducing the resetting force on the metering member 3. The electromagnetic valve 37 is preferably sequentially controlled, that is, the ratio of the opening to the closing period of the electromagnetic valve 37 is varied.

Figure 2:
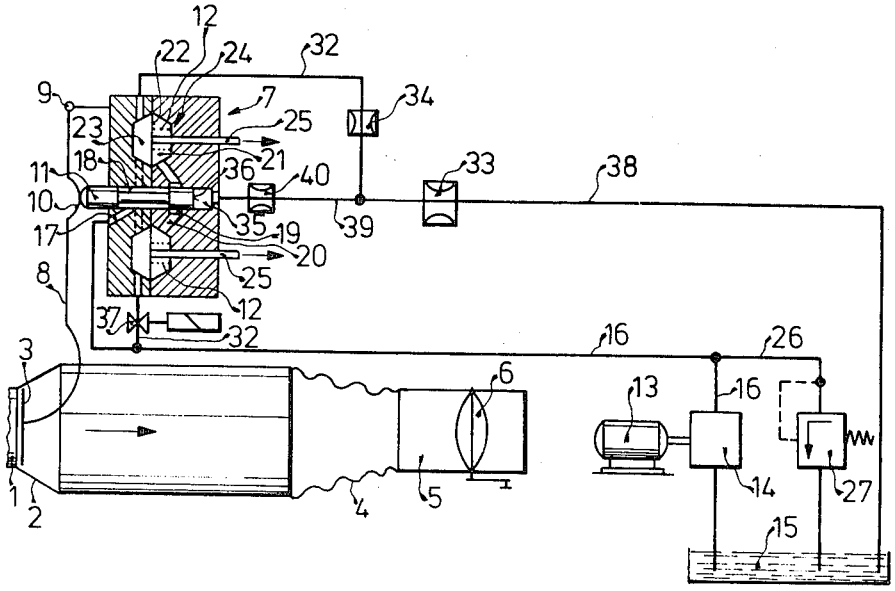

The second embodiment shown in FIG. 2 differs from the first embodiment shown in FIG. 1 in that the electromagnetic valve 37 is disposed in the vicinity of the connection point between the fuel supply line 16 and the control pressure line 32 and in that the control chamber 23, the second throttle 34, the pressure chamber 35 and the first throttle 33 are disposed in the control pressure line 32 downstream of the electromagnetic valve 37. The electromagnetic valve 37 is controlled as a function of the operating parameters of the internal combustion engine in a similar manner to that described in relation to the embodiment shown in FIG. 1. However, in this embodiment, the enrichment of the fuel-air mixture results largely from the increase in the differential pressure and a higher pressure is required in this system. High enrichment rates are obtained with low keying ratios of the sequentially controlled electromagnetic valve 37.

The embodiments shown in FIGS. 1 and 2 could also be designed without the second throttle 34 (not shown in this form), thereby eliminating pressure division between a first throttle 33 and a second throttle 34. In this case, enrichment would be obtained as a result of a pressure reduction in the pressure chamber 35 and thus by reducing the resetting force on the air metering member 3. This enrichment is relatively small in comparison with the enrichment obtained by reducing the differential pressure at the control slots 19 of the metering valves 18, 19.

In both embodiments, the sequential arrangement of the control chamber 23 of the regulating valves 24 and the pressure chamber 35 could also be altered in such a way that the pressure chamber 35 is disposed upstream of the control chamber 23 (not shown). However, in this event, it would be necessary to use higher pressures in the system as the enrichment of the fuel-air mixture resulting from the pressure reduction in the pressure chamber 35 must be kept relatively low in order not to obtain an excessive enrichment as a result of the differential pressure reduction at the control slots 19 of the metering valves 18, 19.

The operation of the electrical control device 42 described herein will be better understood from a reading of the disclosure of the Wessel U.S. Pat. No. 3,981,288, issued Sept. 21, 1976 and assigned to the assignee of this application.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for internal combustion engines comprising a suction tube in which a metering member and an arbitrarily actuatable throttle valve are disposed in series with one another and wherein said metering member is displaced by flowing air depending on the air flow rate in opposition to a resetting force a fuel supply line, a metering valve disposed in said fuel supply line said metering valve including a movable valve member, an actuating element connected to said metering member for displacing said movable valve member for the purpose of metering out a fuel quantity in proportion to the air quantity, said metering valve including a pressure chamber into which projects an effective face of said movable valve member of said metering valve, means for supplying fuel to said pressure chamber in said metering valve for producing a resetting force on said effective face of said movable valve member whereby a metering operation is carried out under a constant pressure difference which can be varied as a function of the operating parameters of the internal combustion engine, a regulatory valve means, said regulatory valve means including movable valve elements, having first and second sides arranged to adjust a pressure difference at the metering valve such that the first side is biased by fuel pressure downstream of the metering valve and the second side is biased by pressure in a control pressure line wherein said control pressure line is connected to the regulating valve and said pressure chamber in said metering valve into which projects the effective face of the movable valve member and wherein the pressure in said control pressure line may be varied by varying the pressure difference of at least a first throttle by means of an electromagnetic valve which is disposed in said control pressure line and which is controllable as a function of a plurality of operating parameters and wherein the electromagnetic valve is connected to simultaneously vary the pressure difference at the metering valve and alter the resetting force to the movable member.

2. A fuel injection system as claimed in claim 1, wherein said electromagnetic valve is sequentially controllable.

3. A fuel injection system as claimed in claim 1, wherein said first throttle is disposed in the vicinity of the connection of said control pressure line and said fuel supply line and said electromagnetic is disposed downstream of said first throttle with the regulating valve means and said pressure chamber inserted therebetween.

4. A fuel injection system as claimed in claim 3, wherein a second throttle means is disposed in the vicinity of said control pressure line between said regulating valve means and said pressure chamber.

5. A fuel injection system as claimed in claim 4, wherein said regulating valve means are disposed downstream of said first throttle and said second throttle, said pressure chamber and said electromagnetic valve being disposed downstream of said regulating valve means in said control pressure line.

6. A fuel injection system as claimed in claim 1, wherein said electromagnetic valve is disposed in proximity to a juncture point of said control pressure line and said fuel supply line and said first throttle is downstream thereof in series with said regulating valve means and said pressure chamber.

7. A fuel injection system as claimed in claim 6, wherein a second throttle is disposed between said regulating valve means and said pressure chamber in the region of said control pressure line.

8. A fuel injection system as claimed in claim 7, wherein said regulating valve means are disposed downstream of said electromagnetic valve and a second throttle, and said pressure chamber and said first throttle are disposed downstream of said regulating valve means in said control pressure lines.

* * * * *